United States Patent [19]

Barannik et al.

[11] 4,076,472

[45] Feb. 28, 1978

[54] CENTRIFUGAL PELLETIZER

[76] Inventors: Ivan Andreevich Barannik, prospekt Lenina, 182a, kv. 22; Alexandr Nikolaevich Kachurka, Severo-Koltsevaya ulitsa, 6 kv. 12, both of Zaporozhie; Ivan Vasilievich Zharovsky; Alexandr Fedorovich Trukhin, both of ulitsa Zhdanova, 11, kv. 32, Kalush Ivano-Frankovskoi oblasti; Viktor Georgievich Raskatov, ulitsa Khimikov, 14, kv. 18, Kalush Ivano-Frankovskoi oblasti; Alexandr Borisovich Mazurkevich, ulitsa B.Khmelnitskogo, 22, kv. 19, Kalush Ivano-Frankovskoi oblasti, all of U.S.S.R.

[21] Appl. No.: 746,308

[22] Filed: Dec. 1, 1976

[30] Foreign Application Priority Data

Dec. 4, 1975 U.S.S.R. ..... 2196201

[51] Int. Cl.[2] ..... B29C 5/04

[52] U.S. Cl. ..... 425/8; 264/8

[58] Field of Search ..... 425/6, 8, 10; 264/8

[56] References Cited

U.S. PATENT DOCUMENTS

| | | | |
|---|---|---|---|
| 1,352,623 | 9/1920 | Perry | 425/8 X |
| 3,601,847 | 8/1971 | Uritskozo et al. | 425/8 |
| 3,988,398 | 10/1976 | Frenken et al. | 425/8 X |

*Primary Examiner*—Robert L. Spicer, Jr.

*Attorney, Agent, or Firm*—Lackenbach, Lilling & Siegel

[57] ABSTRACT

The centrifugal pelletizer proposed in the present invention is applicable for producing pellets from a molten metal, such as magnesium or aluminium. The pelletizer comprises a hollow drive shaft, which is enclosed in a housing and rotates in bearings, and a hollow transmission shaft accommodated in the hollow drive shaft so as to define an annular gap between it and said drive shaft. The bottom end of the transmission shaft is rigidly coupled to the drive shaft. In addition, the transmission shaft features a frictional coupling with the drive shaft provided in the bottom portion thereof. In such a centrifugal pelletizer any contact of the molten metal with the drive shaft is fully obviated, which provides for favorable conditions for operation of both said shaft and the bearings in which it rotates.

2 Claims, 1 Drawing Figure

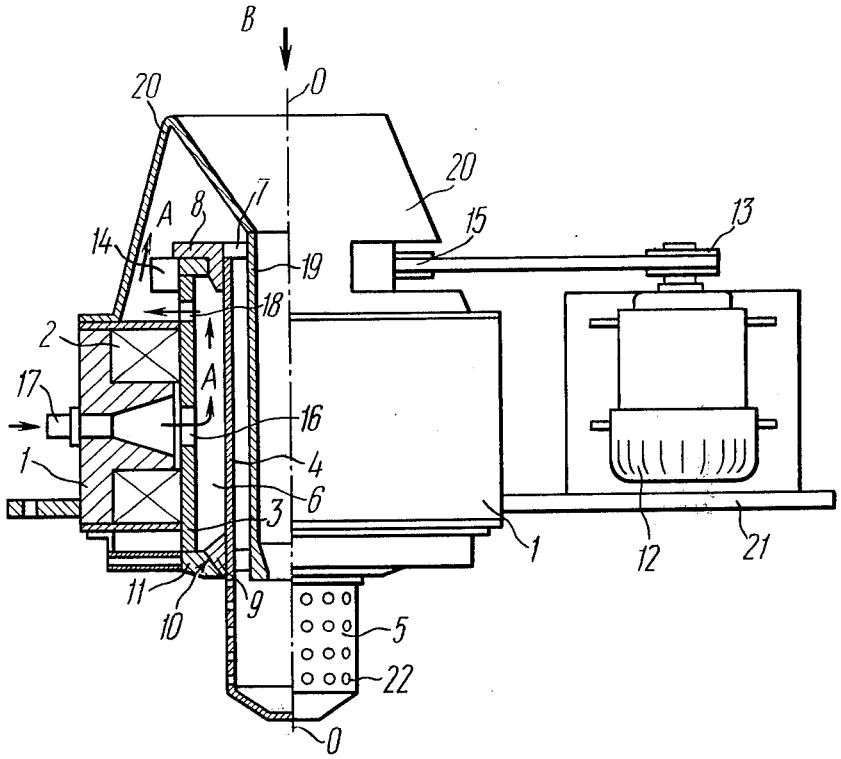
B
0
20
20
7
8
A
14
19
15
13
18
2
A
17
16
1
4
6
3
1
12
21
11
10
9
5
22
0

CENTRIFUGAL PELLETIZER

The present invention relates generally to devices for spraying molten substances, and has particular reference to centrifugal pelletizers which are most advantageously applicable for producing pellets from a molten metal, such as magnesium, aluminium, etc.

It is currently known to use some centrifugal pelletizers to produce pellets from concentrated solutions. Said pelletizer features its perforated bowl set on a hollow drive shaft enclosed in a house with bearings and connected from below to the feed vessel communicating with the compensation vessel. Such a pelletizer provides for a controlled feed of the solution to the perforated bowl and its uniform egress from all the perforations of the bowl. The hollow drive shaft also serves in this case as a feed tube through which the solution is fed to the perforated bowl.

Application of the abovesaid centrifugal pelletizer for producing pellets from molten metal, however, involves some difficulties; thus, for example, it is impossible to render its construction rigid since the molten metal being handled has a temperature of the order of 700 to 750° C, a temperature at which both the housing and bearings are liable to melt. The result is that the pelletizer goes out of order within a very short service period.

It is known to use another centrifugal pelletizer, wherein the perforated bowl is held to the hollow drive shaft from below through a flanged joint. However, as practical experience has shown, such a construction likewise proves to be practically inoperable, since as the liquid metal is expelled through the bowl perforations, the passage area of the latter progressively decreases, whereby the metal efflux velocity is reduced and the molten metal gets accumulated within the bore space of the hollow drive shaft to fully clog said space and solidify there, thus resulting in discontinuing the pellet formation process and in seizure of the bearings.

Thus, to render the pelletizer operable again it should be subjected to a complete dismantling and the solidified metal should be removed. To achieve this the bowl complete with the shaft has to be immersed in a salt-solution bath. This inflicts deformation upon the shaft and its rapid deterioration.

It is a primary object of the present invention to provide a centrifugal pelletizer, wherein the perforated bowl would be interconnected to the hollow drive shaft in such a manner as to permit quick replacement of the bowl without resorting to a total dismantling of the pelletizer and, thereby, to increase the efficiency and prolong the service life thereof.

Said object is accomplished by a centrifugal pelletizer comprising a hollow drive shaft rotating in bearings inside a housing and a perforated bowl featuring a vertical axis of rotation. According to the invention a hollow transmission shaft is accommodated in the hollow drive shaft so as to define an annular gap between it and said drive shaft,the bottom end of said transmission shaft carrying the perforated bowl and the top end being rigidly coupled with the drive shaft.

Owing to the fact that the transmission shaft is mounted inside the hollow drive shaft, any direct contact of molten metal with the drive shaft is obviated which provides favorable conditions for operation of said shaft and of the bearings in which it runs.

Furthermore, this makes it possible to effect quick replacement of the perforated bowl without dismantling the entire pelletizer, by merely disconnecting the flanged joint.

The annular gap defined between the drive and transmission shafts causes to a reduced heat load upon the bearings and thus provides for more prolonged continuous operation of the pelletizer.

Further, the invention is also characterized in that the hollow transmission shaft is frictionally coupled to the drive shaft at a point adjacent to the location of the perforated bowl. Provision of a frictional connection facilitates the mounting of the pelletizer, since said connection serves as a support restricting the movement of the transmission shaft with respect to the drive shaft. Moreover, said connection adds to the dependability in transmitting rotary motion from the drive shaft to the transmission shaft and obviates any runout of the transmission shaft during rotation of the perforated bowl, which provides for a stable expelling of the molten metal through the bowl perforations and, accordingly, ensures normal pellet forming conditions.

The invention is also characterized in that some openings through which a fluid coolant can pass to and let out from the annular gap, are provided in the drive shaft at the place of its interconnection with the transmission shaft. This gives additional cooling to the drive shaft and thus prolongs the service period of the housing bearings.

Thus, the herein-proposed centrifugal pelletizer is favorably comparable to those now in current use in being more reliable in operation and simple in attendance and in having higher efficiency and longer service life.

In what follows the present invention is illustrated in a detailed description of a specific embodiment of a centrifugal pelletizer. In the accompanying drawing, a general, longitudinal partly in section, view of a pelletizer is represented.

The centrifugal pelletizer comprises a housing 1 which accommodates a vertical hollow drive shaft 3 rotating in bearings 2. The drive shaft 3 has openings at both ends through which a hollow transmission shaft 4 is fitted into its bore, the bottom end of said transmission shaft carrying a perforated bowl 5.

An annular gap 6 is defined in between the transmission shaft 4 and the drive shaft 3, both shafts being arranged concentrically and having a common vertical axis O—O which is in effect the axis of rotation of the perforated bowl 5. The transmission shaft 4 has its top end 7 open and is so mounted inside the drive shaft that the perforated bowl 5 extends beyond the drive shaft 3 as shown in the drawing.

The transmission shaft 4 is rigidly coupled with the drive shaft 3 through a flange 8 which is on the outer side of the top end 7 of the transmission shaft 4. The abovesaid rigid connection of the flange 8 to the butt end of the shaft 3 is effected by any of the heretofore known bracing members, such as screws. In addition, the transmission shaft 4 is frictionally coupled with the drive shaft 3 at the bottom thereof by virtue of an additional flange 9 having a tapered surface 10 adapted to contact a similar surface of a flange 11 provided on the drive shaft 3. The flanges 9 and 11 are adapted not only for joining the transmission shaft 4 with the drive shaft 3 but also for playing the part of a friction coupling and of an additional bearing for the transmission shaft 4 that restricts its downward motion.

The drive shaft 3 is rotated by an electric motor 12 by means of pulleys 13 and 14 and a belt drive 15, the pulley 14 being set in position on the drive shaft 3.

An opening 16 is provided in the drive shaft 3 between the flanges 8 and 11. The opening 16, as well as an opening in the housing 1 and a union 17, serves to feed a fluid coolant, such as a gas to the annular gap 6, said coolant escaping through an opening 18 in the shaft 3 in flowing in the direction indicated by the arrow A.

A funnel 19 is inserted into the transmission shaft 4 through its open top end 7, said funnel being held to the housing 1 by a flange 20 and by any of the heretofore known bracing members, such as screws.

The centrifugal pelletizer is mounted on a base 21 to which are secured the housing 1 and the motor 12.

The herein-proposed centrifugal pelletizer operates as follows.

Upon energizing the motor 12 rotation is transmitted through the pulleys 13, 14 and the belt drive 15 to the hollow drive shaft 3 and therefrom through the flanges 8, 11 and 9 to the transmission shaft 4 and the perforated bowl 5.

Molten metal is continuously fed to the funnel 19 in the direction shown by the arrow B and from there to the perforated bowl 5, wherefrom the molten metal is urged by virtue of centrifugal forces to expel through perforations 22 into the surrounding space, thus forming sprayed pellets.

A gaseous coolant is continually fed to the annular gap 6 through the union 17 and the opening 16, said gas escaping through the opening 18 to the space under the funnel, the direction of the gas flow being indicated by the arrow A.

Whenever it becomes necessary to replace the bowl, it is attained by merely backing off the screws holding the flange 20 of the funnel 19 to the housing 1 and the flange 8 of the transmission shaft 4 to the drive shaft 3, whereupon the funnel 19 and the transmission shaft 4, together with the perforated bowl 5, are taken off and replaced by new ones.

We claim:

1. A centrifugal pelletizer, comprising: a housing with bearings; a hollow drive shaft vertically mounted in the bearings inside said housing; a hollow transmission shaft accommodated in said hollow drive shaft so as to define an annular gap between said transmission shaft and said drive shaft, openings being provided in the drive shaft at the point of its interconnection with the transmission shaft to allow a fluid coolant to pass to and let out from the annular gap, a top end of said transmission shaft being rigidly coupled with said drive shaft; a perforated bowl mounted on the bottom end of said transmission shaft; and means for rotating said drive shaft.

2. A centrifugal pelletizer as claimed in claim 1, wherein the hollow transmission shaft is frictionally coupled to the drive shaft at a point adjacent to the place of installation of the perforated bowl.

* * * * *